US005604956A

United States Patent [19]

Grass

[11] Patent Number: 5,604,956

[45] Date of Patent: Feb. 25, 1997

[54] SINGLE PIVOT HINGE WITH SELF-CLOSING MECHANISM

[75] Inventor: Alfred Grass, Höchst/Vlbg., Austria

[73] Assignee: Grass AG, Hochst/Vlbg., Austria

[21] Appl. No.: 514,520

[22] Filed: Aug. 11, 1995

[51] Int. Cl.[6] ..... E05F 1/08

[52] U.S. Cl. ..... 16/278; 16/277; 16/335; 16/341; 16/296

[58] Field of Search ..... 16/286, 287, 277, 16/278, 335, 341, 296, 371

[56] References Cited

U.S. PATENT DOCUMENTS

| | | | |
|---|---|---|---|
| 1,740,866 | 12/1929 | McBarron | 16/335 |
| 3,205,532 | 9/1965 | MacDonald | 16/278 |
| 3,237,239 | 3/1966 | Rudnick | 16/341 |
| 3,550,187 | 12/1970 | Swartz | 16/277 |
| 3,590,420 | 7/1971 | Salice | 16/335 |
| 3,840,936 | 10/1974 | Sato | 16/286 |
| 4,332,055 | 6/1982 | Rudnick et al. | 16/335 |
| 4,716,622 | 1/1988 | DeBruyn | 16/335 |
| 4,894,884 | 1/1990 | Lautenschlager, Jr. | 16/278 |
| 5,355,557 | 10/1994 | Cress et al. | 16/296 |
| 5,517,724 | 5/1996 | Beneke | 16/335 |

FOREIGN PATENT DOCUMENTS

| | | | |
|---|---|---|---|
| 4937 | of 1882 | United Kingdom | 16/277 |

*Primary Examiner*—M. Rachuba
*Assistant Examiner*—Christopher Kirkman
*Attorney, Agent, or Firm*—Petree Stockton, LLP

[57] ABSTRACT

A hinge with self-closing mechanism includes a hinge arm fastened swivelable to a hinge cup and also includes an elastic element which lies with one end of the elastic element on the hinge arm and disposed outside the hinge cup under the bottom of the hinge cup.

12 Claims, 3 Drawing Sheets

SINGLE PIVOT HINGE WITH SELF-CLOSING MECHANISM

This invention relates generally to hinge devices and relates more particularly to hinge constructions for the doors of cabinets or the like.

DESCRIPTION OF THE PRIOR ART

U.S. Pat. No. 3,613,151 (Anderson et al.) teaches a hinge construction providing a self-closing mechanism and comprising a cabinet hinge wing and a door hinge wing connected by a hinge pin. In the cabinet hinge wing there is provided a housing to accommodate springs pressing on the door hinge wing. However, the structure renders assembly difficult since the springs must be held in their place while the door hinge wing is connected to the cabinet hinge wing. Moreover, as can be seen from the drawings, the construction will extend considerably out of the surface plane of the cabinet thereby limiting the space available for the user.

DE 36 01 682 A1, which relates to the same applicant, discloses a hinge construction comprising a hinge cup and a hinge arm attached thereto. In the inside of the hinge cup, there is provided an elastic means touching the hinge arm with one end. However, in order to fix the elastic means, a further holding means is necessary (see part 6 in FIG. 1 of DE 36 01 682 A1). This holding means must be installed separately and will lead to a significant rise in costs and assembling time.

OBJECTS OF THE INVENTION

Therefore, the purpose of the invention is to make a hinge available that is self-closing and has a simple construction.

An additional purpose of the invention is to make a hinge of this type available that is easily assembled.

Still another purpose of the invention is to make a hinge available that requires less space.

SUMMARY OF THE INVENTION

The hinge, according to the submitted invention, includes a hinge arm, a hinge cup with a bottom and an elastic device which is fastened to the hinge cup and is placed with one end at the hinge; whereby the elastic device is located outside the hinge cup under its bottom.

The elastic device can hereby either be supported directly to the hinge arm, that is, braced to one of the attached radial cams on the hinge arm, or operate by means of a roller which then works correspondingly on a radial cam on the hinge arm.

It is preferred that when the elastic device is formed as a basic U-shaped spring, that it is placed for the most part parallel to the bottom of the hinge cup and is at least partially placed there.

It is preferred that the hinge cup is then provided with a projection nose in its inner space to which the spring can be fastened. The spring can either be a U-shaped expansion which overlaps this projection nose or have one or more windings which can encompass or engage around the projection nose.

BRIEF DESCRIPTION OF THE DRAWINGS

The object of the present invention shall be more closely explained in the annexed drawings wherein.

DESCRIPTION OF PREFERRED EMBODIMENTS

Figure 1:
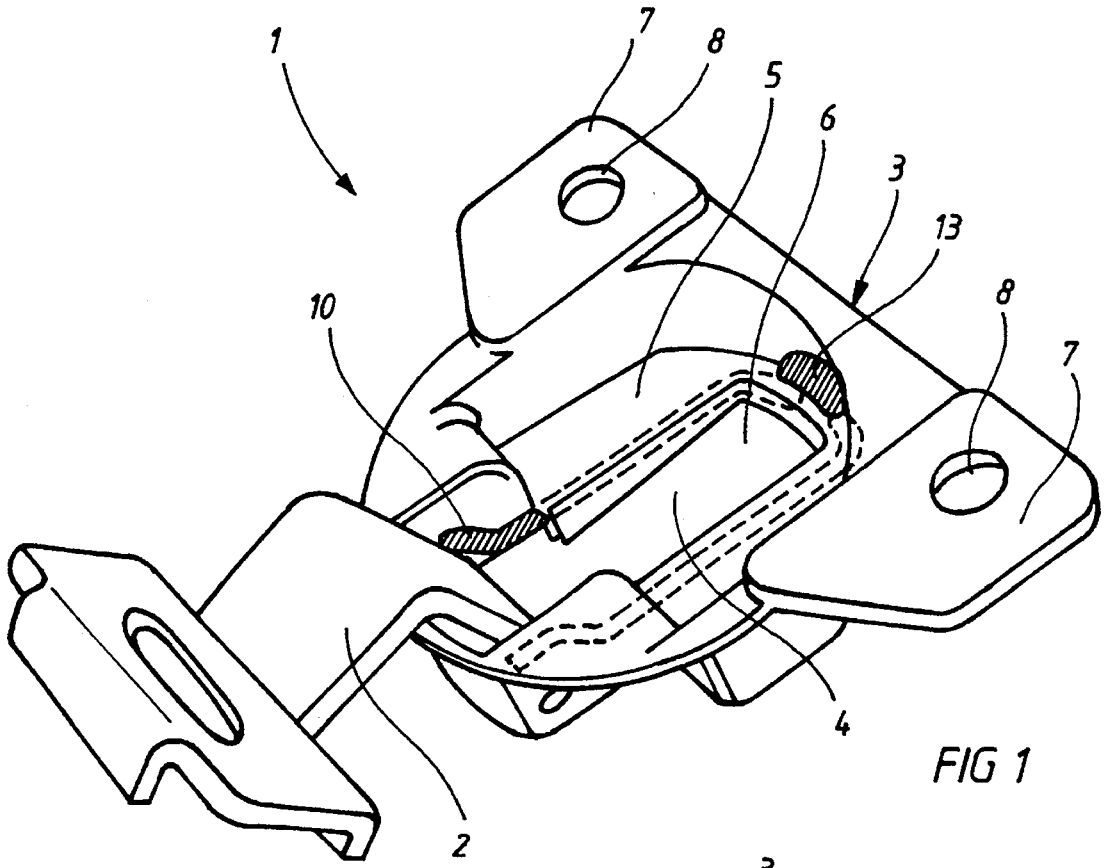
FIG. 1 is a perspective top view of an invention related hinge.

The invention is more closely described by following the annexed drawings which are simply to be understood as preferred examples of embodiments.

In the drawings, the invention related hinge is designated with the reference number 1. The hinge (1) consists basically of a hinge arm (2), which is attached swiveling to a hinge cup (3). The hinge cup (3) has an inner space (4), as well as two bottom areas (5) and an additional area (6) in the middle between both bottom areas.

Beyond that, on the hinge cup (3) is a flange (7) which is provided with corresponding notch (8) to fasten to a cabinet component not closely described.

The hinge arm (2) and the hinge cup (3) are placed swiveling around the axis (9) against each other.

Figure 2:
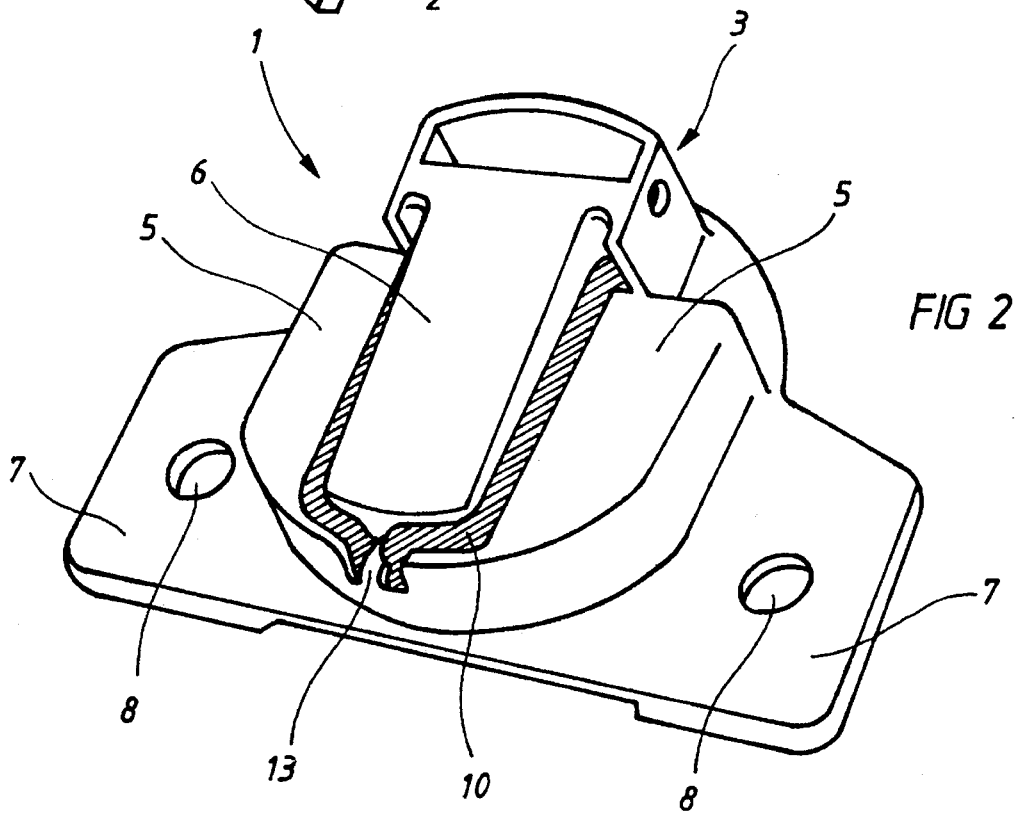
FIG. 2 is a perspective view of the underside of an invention related hinge.

It is already known from the state of technology, in order to fix the opposing position of the hinge arm and the hinge cup in one or more given positions, an elastic element is provided that functions on the hinge cup. According to the invention, it is now provided that this elastic element is located on the outside of the hinge cup under its bottom. In the embodiments made known by FIGS. 1 to 3, this elastic element (10) runs basically parallel to the slanted running bottom area (5) and can lie against bottom area (5). A lateral guide of the elastic element or spring (10) is thereby guaranteed by the middle bottom area (6).

The spring (10) lies with its front end area (11) near the axis (9) on the hinge arm (2) or an add-on piece. It is especially apparent in FIG. 3 that the bearing surface on the hinge arm (2) is not formed continuously, but instead has a step. As long as the end area (11) of the elastic element (10) lies on this step, the elastic element is formed and presses there with a relatively strong force on this step. When the hinge arm (2) swings against the hinge cup (3), the end area (11) of the elastic element (10) reaches beyond engagement with this step and is thereby slack.

Figure 3:
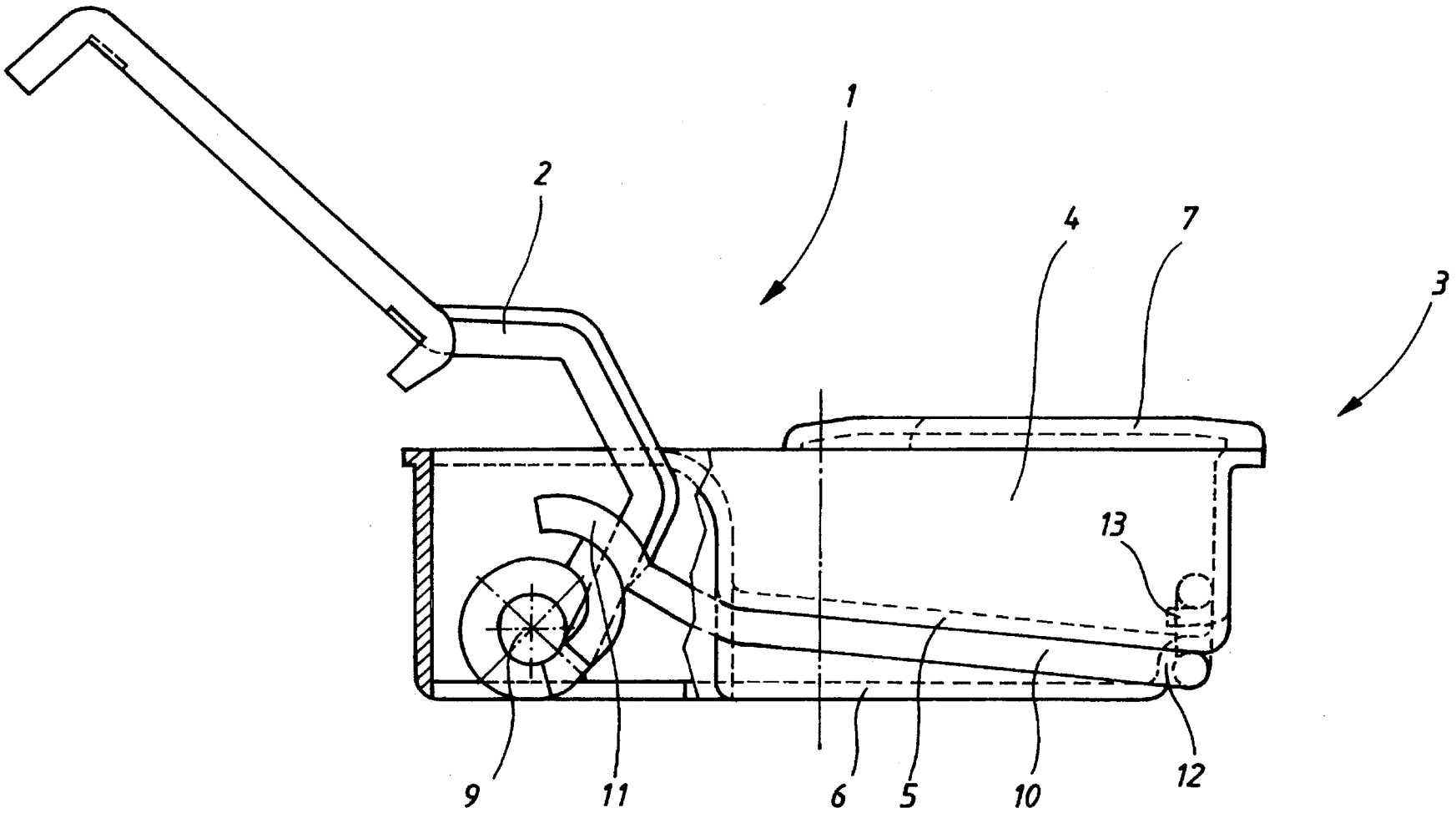
FIG. 3 is a cross section in the vertical direction of an invention related hinge in a first embodiment.

As soon as the hinge arm (2) shall be swiveled left, again in FIG. 3, the elastic element (10) must first be formed. Therefore, the cooperating action between the step on the hinge arm (2) and the elastic element (10) fixes a preferred position of the hinge arm (2) in relation to the hinge cup.

On its other end area (12) the elastic element (10) is held by the attached projection nose (13) on the hinge cup (3). The elastic element (10) is also dependably held with both its end areas (11, 12) on the hinge arm (2) respectively by the projection nose (13) and fits with its middle area on the bottom area (5) of the hinge cup (3).

Figure 4:
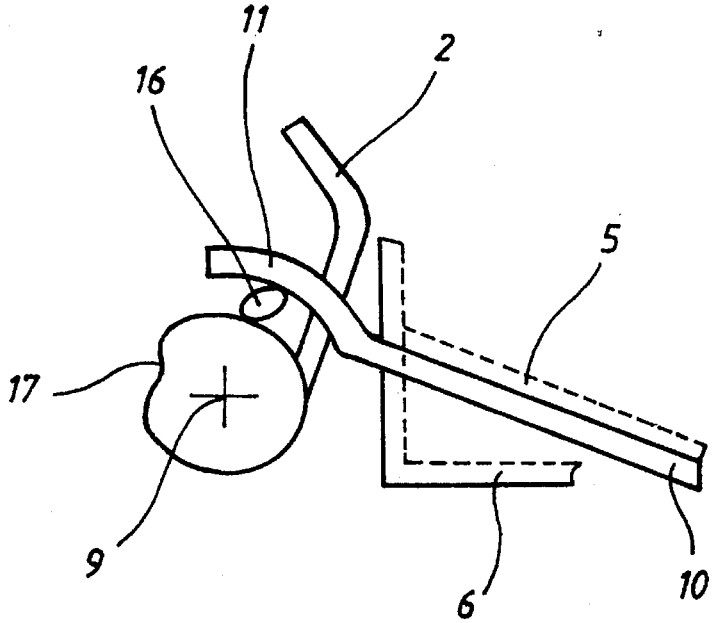
FIG. 4 is a perspective representation of the spring in a first embodiment.

In the embodiment according to FIG. 4, which shows an enlarged detail of FIG. 3 in an additional embodiment of the invention, the elastic element (10) does not lie directly on the hinge arm (2). A roller (16) may also be provided, which is held between the corresponding part of the hinge arm (2) and the front end area (11) of the elastic element (10). The side sliding safety feature is provided by the vertical running walls of the hinge cup (3).

In order to assure a preferred reciprocal position of the hinge arm (2) and the hinge cup (3), an indentation (17) is provided. With a corresponding turn of the hinge arm (2), the roller (16) is placed in the indentation (17) which leads to a loosening of the elastic element (10). In this way a preferred reciprocal position of the hinge arm (2) and the hinge cup (3) is guaranteed.

Figure 5:
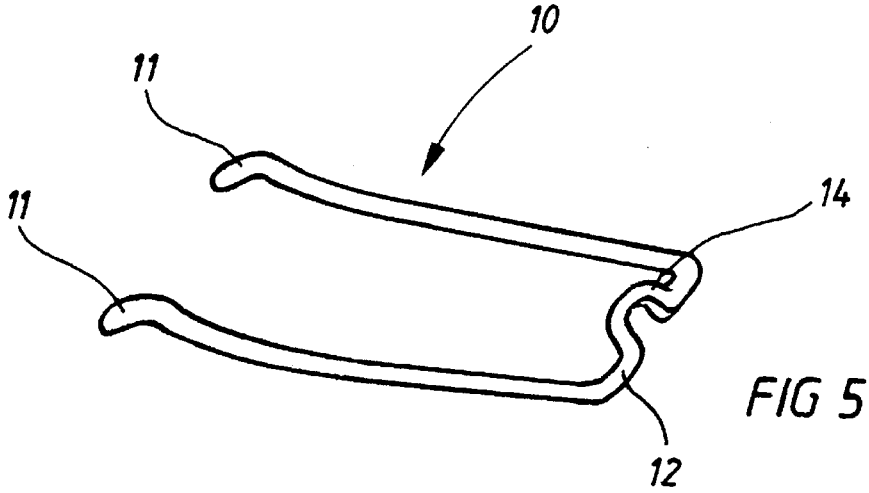
FIG. 5 is an enlarged view according to FIG. 3 of the contact position between the elastic element and the hinge arm in a second embodiment.
Figure 6:
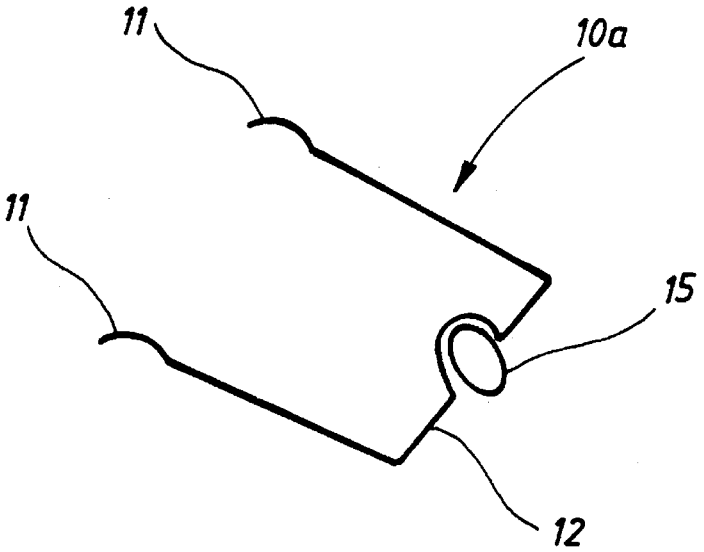
FIG. 6 is a schematic perspective representation of the spring similar to FIG. 4 in a second embodiment.

FIGS. 5 and 6 show two embodiments for the elastic element (10). It is hereby, as already described, preferred that the elastic element (10) is formed in a fundamentally U-shaped spring. The front end areas (11) are preferred to be at least partially rounded in order to achieve a better arrangement of the hinge arm relative to the roller (16).

In the end area (12) of the elastic element (10), according to FIG. 5, an indentation (14) is provided, which overlaps the attached projection nose (13) on the hinge cup (3). The elastic element (10) is thus dependably guaranteed not to fall out of the hinge.

In the embodiment according to FIG. 6, it is preferred that the indentation (14) in end area (12) of elastic element (10*a*) is replaced by one or more windings (15) which likewise overlap the projection nose (13) of the hinge cup (3).

It can also additionally be preferred that the elastic element (10) is provided with pre-stress. This leads to the elastic element (10) always dependably being held, independent from the mutual position of the hinge arm (2) and hinge cup (3), and lying on the corresponding built-on pieces. Thus, rattling or clicking of the elastic element is avoided.

This pre-stress, by way of example embodied in FIG. 3, is so that the elastic element (10) is formed such that in each desired position of the hinge arm (2) to the hinge cup (3) a certain pre-stress is still provided.

What is claimed is:

1. A hinge comprising:

a hinge cup with a bottom and a projection nose, the hinge cup bottom including two slanting bottom areas and a flat middle bottom area disposed between the slanting bottom areas;

a hinge arm pivotably connected to the hinge cup;

a pivot axis pivotally connecting the hinge arm to the hinge cup and having a bearing surface; and an elongate elastic element with two substantially parallel legs having two partially rounded front end areas and joined at an opposite end area, wherein the elastic element is positioned outside and under the bottom of the hinge cup with the parallel legs lying against the slanting bottom areas, the opposite end area of the elastic element being held by the projection nose, and the front end areas of the elastic element parallel legs acting on the bearing surface of the pivot axis.

2. A hinge according to claim 1, wherein the bearing surface is a radial cam on said hinge arm.

3. A hinge according to claim 2, wherein the front end areas of the elastic element parallel legs act on a roller which in turn acts on the radial cam on the hinge arm.

4. A hinge according to any one of claims 1 to 3, wherein said elastic element is formed as a generally U-shaped spring.

5. A hinge according to claim 4, wherein said spring is placed substantially parallel to the slanting bottom areas of the hinge cup.

6. A hinge according to claim 5, wherein said spring has a generally U-shaped indentation overlapping said projection nose of said hinge cup.

7. A hinge according to claim 5, wherein said spring has at least one winding which encompasses the projection nose of said hinge cup.

8. A hinge according to any one of claims 1 to 3, wherein said elastic element is pre-stressed.

9. A hinge according to claim 1, wherein the flat middle bottom area of the hinge cup is elongate and includes opposing lateral edges and a depending ledge extending from each of the lateral edges substantially perpendicular to the flat middle bottom area, and wherein each of the two slanting bottom areas extends from a respective one of the depending ledges substantially perpendicular to the depending ledge to define respective recesses in the hinge cup bottom adjacent the flat middle bottom area, and wherein the parallel legs of the elastic element lie in respective ones of the recesses substantially parallel to the slanting bottom areas.

10. A hinge according to claim 9 wherein the front end area of each of the two parallel legs of the elastic element extends at an angle relative to the slanting bottom areas and lies on and exerts a spring force against the bearing surface.

11. A hinge comprising:

a hinge cup having a bottom and a projection nose, the hinge cup bottom including an elongate flat middle bottom area with opposing lateral edges, a depending ledge extending from each of the lateral edges substantially perpendicular to the flat middle bottom area, and additional bottom areas extending from each of the depending ledges substantially perpendicular to the depending ledge to define respective recesses in the hinge cup bottom adjacent the flat middle bottom area;

a hinge arm pivotably connected to the hinge cup;

a pivot axis pivotally connecting the hinge arm to the hinge cup and having a bearing surface; and an elongate wire spring with a pair of substantially parallel legs, each leg terminating in a front end area and joined at an opposite end area, the wire spring being positioned outside and under the bottom of the hinge cup with the parallel legs lying in respective ones of the recesses, the opposite end area of the wire spring being held by the projection nose, and the front end areas of the parallel legs of the wire spring lying on and urging a spring force against the bearing surface of the pivot axis.

12. A hinge according to claim 11, wherein the bearing surface is a radial cam on the hinge arm, and wherein the wire spring is positioned with the parallel legs lying substantially parallel to the additional bottom areas and with the front end areas extending at an angle relative to the additional bottom areas.

* * * * *